US009677838B2

(12) United States Patent
Faxon

(10) Patent No.: US 9,677,838 B2
(45) Date of Patent: Jun. 13, 2017

(54) FIREARM BARREL FLUTING OF VARIED DEPTH AND/OR WIDTH

(71) Applicant: Robert T. Faxon, Cincinnati, OH (US)

(72) Inventor: Robert T. Faxon, Cincinnati, OH (US)

( * ) Notice: Subject to any disclaimer, the term of this patent is extended or adjusted under 35 U.S.C. 154(b) by 0 days.

(21) Appl. No.: 15/262,501

(22) Filed: Sep. 12, 2016

(65) Prior Publication Data

US 2017/0074612 A1 Mar. 16, 2017

Related U.S. Application Data

(60) Provisional application No. 62/219,323, filed on Sep. 16, 2015.

(51) Int. Cl.
*F41A 21/24* (2006.01)
*F41A 21/48* (2006.01)

(52) U.S. Cl.
CPC ..... *F41A 21/24* (2013.01); *F41A 21/482* (2013.01)

(58) Field of Classification Search
CPC ..... F41A 21/24
USPC ..... 42/76.01, 77; 89/14.05
See application file for complete search history.

(56) References Cited

U.S. PATENT DOCUMENTS

| | | | | |
|---|---|---|---|---|
| 1,789,835 | A | 1/1931 | Pedersen | |
| 3,483,794 | A | 12/1969 | Packard | |
| 3,748,957 | A | 7/1973 | Arnold et al. | |
| 4,566,301 | A | 1/1986 | O'Dell | |
| D285,331 | S | 8/1986 | Cellini | |
| 6,324,780 | B1 | 12/2001 | Behling | |
| 6,508,159 | B1 | 1/2003 | Muirhead | |
| 7,013,592 | B2 | 3/2006 | Olson et al. | |
| 7,464,496 | B1 | 12/2008 | Davies et al. | |
| 8,025,003 | B1 | 9/2011 | Saur | |
| D662,169 | S | 6/2012 | Arnedo Vera et al. | |
| D763,392 | S | 8/2016 | Miller, III | |
| 9,446,440 | B2 * | 9/2016 | Engesser | B21C 37/152 |
| D782,598 | S * | 3/2017 | Faxon | D22/108 |

* cited by examiner

*Primary Examiner* — Reginald Tillman, Jr.
(74) *Attorney, Agent, or Firm* — Wood Herron & Evans LLP

(57) ABSTRACT

The present invention provides a fluted firearm barrel and method of making a fluted firearm barrel. An elongated barrel has an exterior surface. A plurality of longitudinally extending, circumferentially spaced apart grooves are formed in the exterior surface. Each groove varies in width multiple times along the length thereof, such that each groove has at least two widened portions with a narrowed portion therebetween.

10 Claims, 4 Drawing Sheets

FIREARM BARREL FLUTING OF VARIED DEPTH AND/OR WIDTH

RELATED APPLICATIONS

This application claims the benefit of and priority to U.S. Provisional Patent Application No. 62/219,323, filed Sep. 16, 2016, the content of which is incorporated by reference herein.

FIELD OF THE INVENTION

This invention relates to fluting on the exterior surface of a firearm barrel. More particularly, it relates to such fluting wherein the depth and/or width of each flute is varied along the length of the barrel.

BACKGROUND OF THE INVENTION

A stiffer firearm barrel will typically be more accurate than one that exhibits inordinate flexing. A firearm barrel having a thicker wall will typically provide a stiffer barrel compared to one with a thinner wall. That is, for a given bore diameter, the larger the outside diameter of the barrel, the stiffer the barrel will be. Of course, thick-walled gun barrels can add significant weight to the firearm. In an effort to gain the benefit of a larger diameter and thicker-walled barrel, yet reduce its overall weight, flutes or groves have been formed along the length of the outer surface of the barrel. These flutes reduce the weight of the barrel while increasing the exterior surface area of the barrel, which can provide more effective cooling of the barrel.

The fluting grooves are typically formed in a longitudinal direction substantially parallel to the bore or, as described in U.S. Pat. No. 6,324,780, issued Dec. 4, 2001, to Carl H. Behling may be cut helically or spirally, if desired. In either style, the depth and width of each flute remains substantially constant along the length of the barrel, except at the terminal ends of each flute.

Another method for treating the exterior surface of a firearm barrel is disclosed in U.S. Pat. No. 7,013,592, issued Mar. 21, 2006, to Douglas D. Olson, et al. This patent teaches having a longitudinal portion of the barrel peripheral surface covered with an array of concaved circular or oblong depressions (dimples) machined in the peripheral surface to a predetermined maximum depth. As with the longitudinal and spiral groove fluting, the circular or oblong concave depressions are disclosed to reduce the weight of the barrel while retaining the barrel's original stiffness and to increase surface area to enhance heat dissipation.

Spiral fluting involves complex machining equipment and processes. Longitudinal fluting creates straight line edges parallel to the bore that may affect the stress performance of the barrel material. The depth and diameter of circular or oblong dimpling, and therefore its effectiveness, is limited on a cylindrical member like a barrel.

SUMMARY OF THE INVENTION

The present invention provides a barrel having a plurality of circumferentially spaced apart grooves formed in an exterior surface thereof, each groove varying in depth and/or width along the length thereof.

The invention also provides a method of fluting the exterior surface of a firearm barrel. An elongated barrel is provided and cutting a plurality of circumferentially spaced apart are cut grooves in the exterior surface. The depth and/or width of each groove is varied along the length thereof. The grooves may extend longitudinally or helically along the barrel.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawings, wherein.

DETAILED DESCRIPTION OF THE INVENTION

Figure 1:
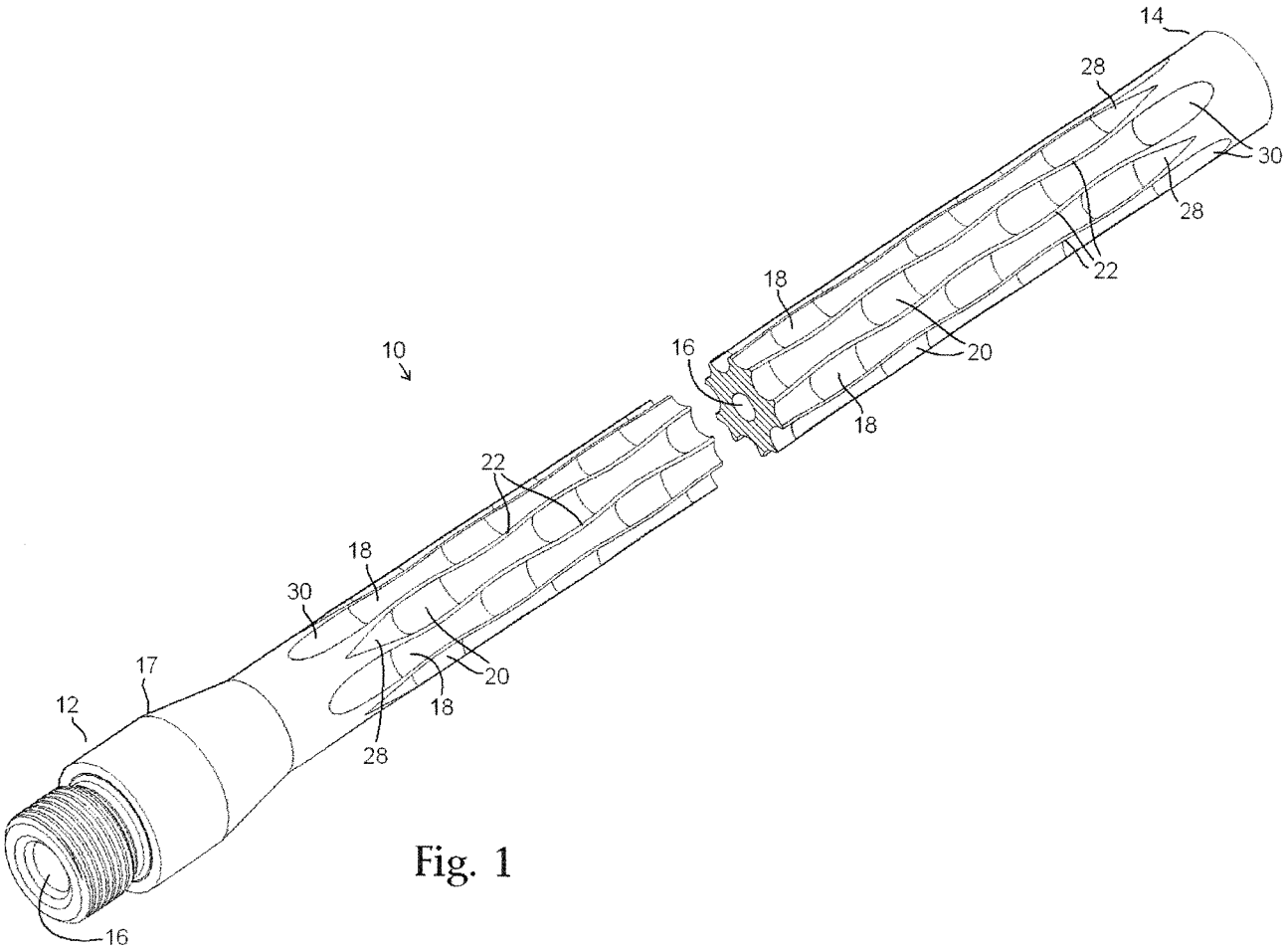
FIG. 1 is a fragmentary isometric view of a firearm barrel having fluting of varied depth and/or width according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
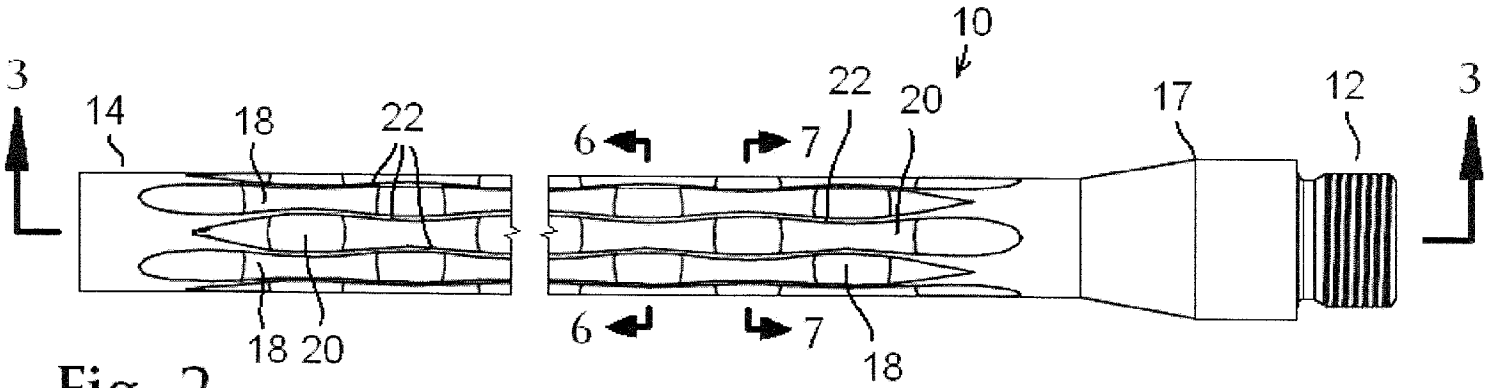
FIG. 2 is a top view thereof.
Figure 3:
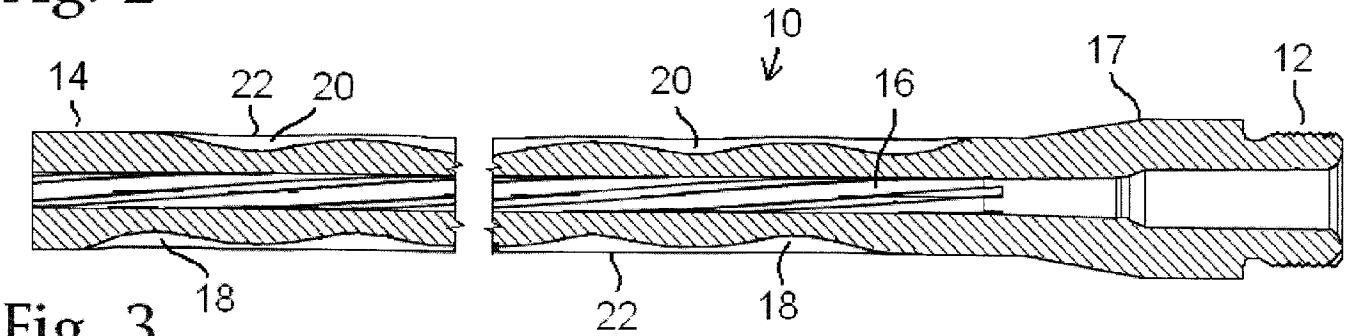
FIG. 3 is a longitudinal sectional view thereof taken substantially along line 3-3 of FIG. 2.

Referring first to FIGS. 1 and 2, therein is shown at 10 a firearm barrel having longitudinal fluting of varied depth and width according to one embodiment of the present invention. The barrel 10 has a chamber/breach end 12, a muzzle end 14, and a longitudinal axial bore 16. The illustrated barrel 10 is of a substantially uniform diameter along its length, except for an enlarged portion 17 at the breach end 12. Fluting according to the present invention may be used, however, on barrels having a tapered diameter or barrels that have different diameters at different longitudinal portions, such as a barrel that accommodates a gas block.

As illustrated, a number of circumferentially spaced-apart and generally longitudinally oriented flutes 18, 20 may be provided on the exterior peripheral surface of the barrel 10. In the illustrated embodiment, both the depth and width of the flutes 18, 20 are varied multiple times at regular intervals along the length of the barrel 10. A variety of different cutting tools may be used and the cutting tools may be oriented either substantially perpendicular to the bore 16 or at an angle thereto as longitudinal cuts are made in the barrel 10.

Figure 4:
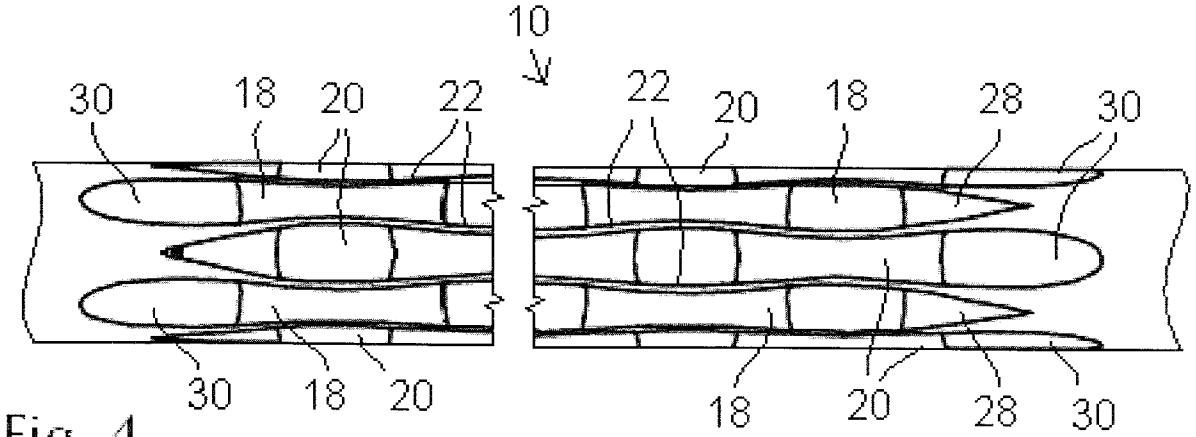
FIG. 4 is an enlarged fragmentary top plan view.
Figure 5:
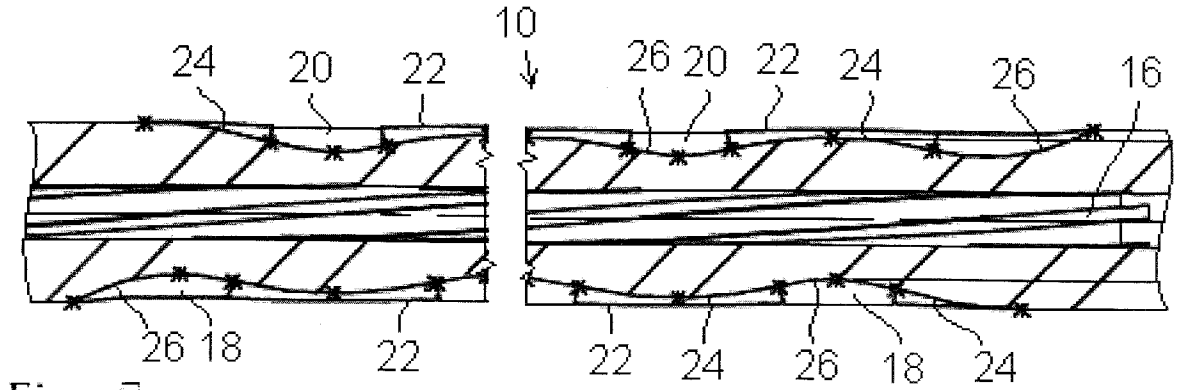
FIG. 5 is an enlarged fragmentary longitudinal sectional view.
Figure 7:
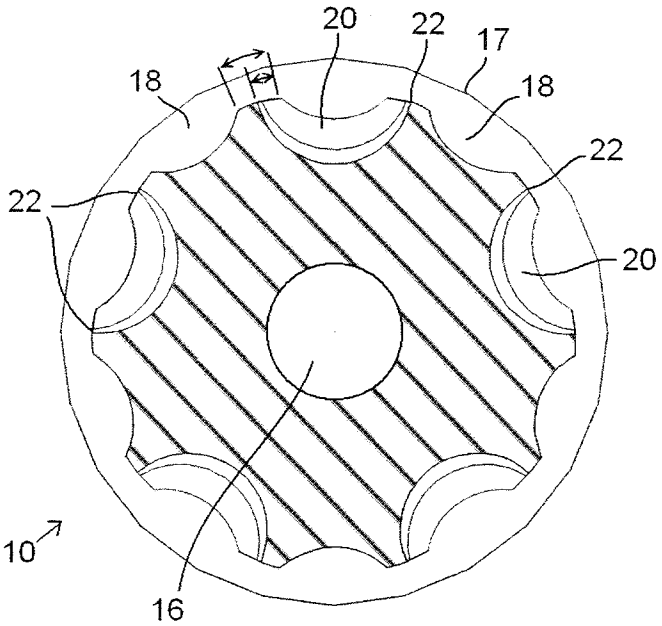
FIG. 7 is a cross-sectional view taken substantially along line 7-7 of FIG. 2.
Figure 6:
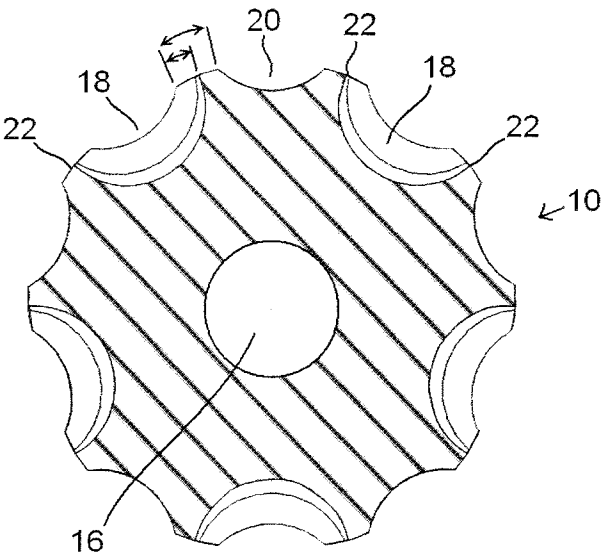
FIG. 6 is a cross-sectional view taken substantially along line 6-6 of FIG. 2.

Referring now also to FIGS. 3-7, it can be seen that the depth of each flute 18, 20 may be varied repeatedly, such as in an oscillating pattern, along the length of the barrel 10. Likewise, as a cutting tool is moved along the length of the barrel 10, the rate at which it plunges into and is lifted from the material of the barrel may vary according to a regular or irregular pattern. As shown in the in the illustrated embodiment, a cutting tool having a rounded face, such as a rounded slot cutter or ball end mill, may be used to cause the width of the flute 18, 20 to vary as the depth varies. Moreover, as illustrated in FIGS. 1, 2 and 6, the longitudinal position at which the depth and width of one flute 18 is at its maximum may be longitudinally staggered relative to an adjacent flute 20 to correspond with the narrowest and most shallow point of the adjacent flute 20. As a result, the size and number of flutes 18, 20 define ridges or lands 22 between each flute 18, 20. According to one embodiment, the alternating varied width and spacing between each flute 18, 20 may be selected such that along the length of each ridge or land 22 there is no longitudinal straight line on the outer surface of the barrel 10 that is uninterrupted by a flute 18, 20. As illustrated by arcuate arrows in FIGS. 6 and 7, as the longitudinally staggered position of wide and narrow portions of the flutes 18, 20 alternates along the length of the barrel 10, the relative circumferential boundaries of the lands 22 between the flutes 18, 20 are shifted beyond a center point therebetween.

Depending on the shape of the cutting tool used, the end shape of each flute 18, 20 may be affected by the rate at which the cutting tool is initially plunged and/or finally withdrawn. For example, as shown in FIGS. 4 and 5, moving from left to right, if the cutter is plunged at an increasing rate relative to the linear distance travelled (corresponding to a convex arcuate path 24), one end pattern 28 is created compared to a different end pattern 30 formed when the same cutter is plunged at a decreasing rate relative to linear distance travelled (corresponding to a concave arcuate path 26). In FIG. 5, an X indicates a change in cutter direction or plunge curve as it is moved relative to the length of the barrel 10. Likewise, at the opposite end of the flute 18, 20, regardless of what depth or width variations are formed in-between, one shape 28 is formed when the cutter is withdrawn at an increasing rate relative to the linear distance travelled (corresponding to a convex arcuate path 24), and a different end pattern 30 is created when the same cutter is plunged at a decreasing rate relative to linear distance travelled (corresponding to a concave arcuate path 26).

Between the ends of each flute 18,20, the linear arcs 24, 26 along which the cutter is moved relative to the barrel material as it progresses linearly also affect the width and shape of the flute 18, 20. Accordingly, a wide variety of ornamental patterns, not necessarily affecting the quality or performance of the barrel relative to different ornamental patterns, may be created by varying the depth and width of flutes 18, 20 along the length of the curved exterior surface of the barrel 10 according to the present invention. If desired, the flutes 18, 20 could be formed helically along the length of the barrel. Additionally, the exterior surface of the barrel does not have to be round. Varied depth and/or width flutes could be formed according to the present invention in a barrel having an octagonal (or other polygonal) exterior profile.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A fluted firearm barrel, comprising:

a barrel having an axial bore and an exterior surface; and a plurality of longitudinally extending, circumferentially spaced apart grooves formed in the exterior surface, each groove varying in width multiple times along the length thereof, such that each groove has at least two widened portions with a narrowed portion therebetween.

2. A fluted barrel of claim 1, wherein the depth of at least one of the plurality of grooves is also varied multiple times along the length thereof, such that each groove has at least two more deepened portions with a less deepened portion therebetween.

3. A fluted barrel of claim 1, wherein adjacent grooves have axially staggered positions of widened portions such that a widened portion of one groove corresponds in axial position to a narrowed portion of an adjacent groove.

4. A fluted barrel of claim 2, wherein adjacent grooves have axially staggered positions of more deepened portions such that a more deepened portion of one groove corresponds in axial position to a less deepened portion of an adjacent groove.

5. A fluted barrel of claim 2, wherein the more deepened portions correspond to the widened portions and the less deepened portions correspond to a narrowed portion.

6. A fluted barrel of claim 3, wherein the circumferential position of the plurality of grooves is sufficiently close that the exterior surface of the barrel between grooves has no uninterrupted straight line along length of barrel between the grooves.

7. A method of fluting a firearm barrel, comprising:

providing an elongated barrel having an exterior surface;

cutting a plurality of longitudinally extending, circumferentially spaced apart grooves in the exterior surface; and varying the width of each groove multiple times along the length thereof, such that each groove has at least two widened portions with a narrowed portion therebetween.

8. The method of claim 7, in which the depth of each groove is also varied multiple times along the length thereof, such that each groove has at least two more deepened portions with a less deepened portion therebetween.

9. The method of claim 7, wherein adjacent grooves are formed to have axially staggered positions of widened portions such that a widened portion of one groove corresponds in axial position to a narrowed portion of an adjacent groove.

10. The method of claim 9, wherein the circumferential position of the plurality of grooves is sufficiently close that the exterior surface of the barrel between grooves has no uninterrupted straight line along length of barrel between the grooves.

* * * * *